US007891105B2

(12) United States Patent
Kramski

(10) Patent No.: US 7,891,105 B2
(45) Date of Patent: Feb. 22, 2011

(54) PUTTER FITTING STATION

(75) Inventor: Wiestaw Kramski, Birkenfeld (DE)

(73) Assignee: Kramski Putter GmbH, Birkenfeld (DE)

( * ) Notice: Subject to any disclaimer, the term of this patent is extended or adjusted under 35 U.S.C. 154(b) by 0 days.

(21) Appl. No.: 12/570,304

(22) Filed: Sep. 30, 2009

(65) Prior Publication Data

US 2010/0083518 A1 Apr. 8, 2010

Related U.S. Application Data

(60) Provisional application No. 61/108,091, filed on Oct. 24, 2008.

(30) Foreign Application Priority Data

Oct. 2, 2008 (DE) ..... 20 2008 013 049 U

(51) Int. Cl.
*G01B 5/00* (2006.01)

(52) U.S. Cl. ..... 33/508

(58) Field of Classification Search ..... 33/508, 33/613, 645

See application file for complete search history.

(56) References Cited

U.S. PATENT DOCUMENTS

| | | | | |
|---|---|---|---|---|
| 3,471,155 | A | 10/1969 | Donaldson | |
| 4,123,060 | A | 10/1978 | Sterling | |
| 4,788,774 | A * | 12/1988 | Boone | 33/508 |
| 4,925,192 | A | 5/1990 | Forbes | |
| 5,870,815 | A * | 2/1999 | Karner et al. | 33/533 |
| 6,449,860 | B1 * | 9/2002 | Nakai | 33/508 |
| 7,263,866 | B2 * | 9/2007 | Latiri | 33/508 |
| 7,403,277 | B2 * | 7/2008 | Goodjohn et al. | 33/508 |
| 7,415,866 | B2 * | 8/2008 | Latiri | 33/508 |
| 2002/0123383 | A1 * | 9/2002 | Cameron | 33/508 |
| 2005/0193582 | A1 * | 9/2005 | Mori | 33/508 |
| 2006/0128492 | A1 | 6/2006 | Hourihan et al. | |
| 2008/0119302 | A1 | 5/2008 | Bennett et al. | |
| 2008/0178483 | A1 * | 7/2008 | Souza et al. | 33/508 |
| 2009/0144997 | A1 * | 6/2009 | Wang | 33/508 |

* cited by examiner

*Primary Examiner*—G. Bradley Bennett
(74) *Attorney, Agent, or Firm*—Volpe and Koenig, P.C.

(57) ABSTRACT

A putter fitting device (1) having a base plate (2) with a fixation device (5) for a putter head (14), which provides a first fixation state for a first, torque-proof fixation of the putter head (14) and a second fixation state for a second, rotational fixation of the putter head (14) in reference to the base plate (2), with the putter head (14) in the second fixation state being rotational in a plate plane of the base plate (2). An adjustable positioning body (11) is connected to the base plate to predetermine a stance of a person in reference to the base plate (2), and alignment markings (9, 27, 29) are provided for a targeted alignment of the putter head (14) in the second fixation state and for controlling a selected alignment of the putter head (14).

20 Claims, 4 Drawing Sheets

PUTTER FITTING STATION

CROSS-REFERENCE TO RELATED APPLICATIONS

This application claims the benefit of U.S. Provisional Application No. 61/108,091, filed Oct. 24, 2008, and German Application No. DE 20 2008 013 049.2, filed Oct. 2, 2008, both of which are incorporated herein by reference as if fully set forth.

BACKGROUND

The present invention relates to a putter fitting device and a putter for the use therewith, which combined form a putter fitting station.

In golfing "fitting" is understood as the entirety of all measures necessary to individually adjust a club to a player, in the present case particularly a putter. In the present case, the above-mentioned entirety comprises, in addition to adjusting the length L of the shaft of the putter and the lie or lie-angle $\alpha$ between the shaft and the ground when the putter head is placed in a planar fashion thereon, also comprises the stance of the player in reference to a golf ball to be putted and the so-called impact resulting therefrom, which in the following is discussed in greater detail.

Putter fitting stations of prior art fail to allow a comprehensive putter adjustment considering all of the above-mentioned factors.

SUMMARY

The invention is therefore based on the object of providing a putter fitting device and a putter to be used in combination therewith, which combined form a putter fitting station, allowing an individual adjustment of the putter to a player considering all of the above-mentioned factors, namely the length of the shaft, the lie, and the impact position.

The invention attains this object in a putter fitting device and a putter having the features of the invention.

Advantageous further developments of the invention are the object of the dependent claims, with their wording hereby being explicitly included in the description in order to avoid any unnecessary repetitions.

According to the invention a putter fitting device comprises:

- a base plate with a fixation device for a putter head, which optionally allows a first, torque-proof fixation of the putter head or a second, rotational fixation of the putter head in reference to the base plate, with the putter head in the second fixation being rotational in the plane of the plate,
- adjustable positioning element for predetermining the stance of a person in reference to the base plate, and
- alignment markings for a targeted alignment of the putter head in the second fixation and for controlling a selected alignment of the putter head.

A putter according to the invention to be used with the putter fitting device according to the invention or one of its further developments comprises a fixation device, embodied to cooperate with the fixation device of the putter fitting device.

According to the basic idea of the present invention it is therefore provided that the putter fitting device allows two different fixation states or types of fittings for the putter head, namely a first torque-proof fixation state and a second fixation state in which the putter head is rotational in reference to the base plate. In the second fixation state the putter head is rotational in the plane of the base plate (plate plane). In the first fixation state, a torque-proof fixation of the putter head allows an adjustment of the lie and the length of the shaft to be performed in a simple manner. Subsequently, in the second rotational fixation state, a determination of the impact position is performed, particularly by way of the respective person performing the fitting closing his/her eyes and concentrating on his/her intuitive addressing position. Here, the person is positioned at a stance in reference to the base plate of the device, which is predetermined by the adjustable positioning element in a reproducible fashion. By the alignment element provided according to the invention for a targeted alignment and/or for controlling a selected alignment of the putter head, which can be changed in the second, rotational fixation, the impact position can then be controlled, which ideally should be "square", which means the putter head impacts a golf ball to be played with an impact surface oriented perpendicular in reference to the direction of impact. Any position of impact deviating therefrom can be corrected by adjusting the stance and changing the respective standing position of the player in reference to the base plate.

This way, the putter fitting device according to the invention allows a comprehensive consideration of the length of the shaft, the lie, and the impact in the putter fitting.

A first further development of the device according to the invention provides that its fixation device for a torque-proof connection to the putter head comprises a first fixation structure in the second fixation. This fixation structure cooperates with a complementary first fixation structure at the putter head such that the desired rotational fixation of the putter head is accomplished, in which the putter head can rotate in the plane of the base plate and/or parallel thereto.

Beneficially, the first fixation structure mentioned represents a protrusion extending perpendicularly in reference to the plane of the plate, particularly a pin or a peg, engaging a corresponding recess at the bottom of the putter head. An alternative embodiment provides for the first fixation structure representing a recess and for the engaging protrusion being provided at the bottom of the putter head.

According to another further development of the device according to the invention, the fixation device comprises a second fixation structure, which cooperating with the above-mentioned first fixation structure serves for a selective blocking of the described rotary motion of the putter head. For this purpose, the above-mentioned second fixation structure cooperates with a complementary second fixation structure at the putter head.

An appropriate further development of a device according to the invention provides for the second fixation structure comprising a recess in the base plate and a fixation element that can be inserted in this recess, with in particular the latter may be embodied as a pin or a peg.

In this context, another further development of the invention provides for the fixation means mentioned to be arranged at the putter head and from there it can be inserted into the above-mentioned recess in the base plate.

Another preferred further development of the device according to the invention provides for the base plate comprising a recess to receive the putter head. The recess mentioned and/or its base can be embodied with a color and/or material other than the rest of the base plate. For example, in the area of the recess a mat with a contrasting color in reference to the base plate or another suitable coating (rubber, carpet, felt, or the like) may be provided. Alternatively, colored enamel may be applied in the area of the recess.

The fixing device is preferably arranged in the area of the recess. Here, the dimensions of the recess are selected such that the free rotation of the putter head in the second fixation is not hindered by the edge of the recess.

Advantageously, at least one positioning device for a golf ball is arranged in the area of the fixation device such that the ball rests in the proximity of the impact area of the putter head when the putter head is located in the first and/or second fixation.

The presence of a golf ball is important because it allows the player and/or the person performing the fitting to orient him/herself when taking the stance for a putt to be played in the same manner as on a golf course.

In order to allow for the putter fitting device according to the invention being used by right-handed as well as left-handed persons a preferred additional further development of the invention provides for the fixation device to be embodied inversely redundant in reference to the base plate. Here, particularly the above-described second fixation structure of the putter fitting device is provided in duplicate.

In order to predetermine the stance of a person in reference to the base plate in a reproducible fashion the putter fitting device according to the invention comprises adjustable positioning element as described above and as generally known from the parallel patent application DE 10 2008 027 152.7 by the same applicant. The positioning element may comprise a straight, oblong element in the form of a rod or the like, which laterally projects from the base plate and can be positioned in reference thereto in various positions.

For this purpose, the base plate may comprise a number of insert openings, into which the oblong element can be appropriately inserted and wherein it is held, in particular detachably, in a clamping fashion.

Beneficially the insert openings are located along a first straight line extending parallel to a second straight line, which is a part of the alignment markings, particularly an alignment line mounted on the base plate, with at least the first fixation structure of the putter fitting device according to the invention also being arranged thereupon and/or its extension.

With regard to the intended use of the positioning element concerning the stance to be assumed, here, particular reference shall be made to the respective explanations in the above-mentioned parallel application by the same applicant, in order to avoid unnecessary repetitions.

A particular further development of the putter according to the invention provides that its fixation device comprises a second fixation structure cooperating with the second fixation structure of the putter fitting device. The above-mentioned second fixation structure of the putter may be embodied particularly as a rear recess, i.e. facing away from the impact surface of the putter, which the fixation element of the putter fitting device engages in order to cause a first, torque-proof fixation of the putter and/or putter head in reference to the base plate.

Advantageously, at least one alignment line is also provided at the putter and/or at the putter head, which at least in the first fixation of the putter and/or putter head at the putter fitting device is aligned with the alignment line present here. This embodiment contributes to control the impact position of the putter after the first fixation has been loosened: when the above-mentioned alignment lines are still aligned even after assuming the intuitive impact position after the first fixation has been loosened, a quasi optimal fitting is given. Alternatively, the stance must be changed with the help of the adjustable positioning element as described above in greater detail.

The first fixation structure of the putter head, e.g., the above-mentioned bottom recess and/or the above-mentioned lower linear protrusion, is reasonably arranged on the putter head alignment line such that it is aligned to the alignment line on the base plate when the impact alignment of the putter head is optimal.

The putter is preferably adjustable with regard to the length of the shaft and/or the lie angle and furthermore it may comprise a device for determining the posture of a person in reference to the putter head, particularly a line-of-sight alignment for synchronizing the center of the eyes and the ball.

The above-described fitting station is particularly suitable for sales and demonstration areas in order to, based on the performed fitting, allowing the "custom made" production of the right putter model using the personal data determined for the person fitted.

BRIEF DESCRIPTION OF THE DRAWINGS

Additional features and advantages of the present invention are discernible from the following description of the exemplary embodiments, using the drawing.

DETAILED DESCRIPTION OF THE PREFERRED EMBODIMENTS

Figure 1:
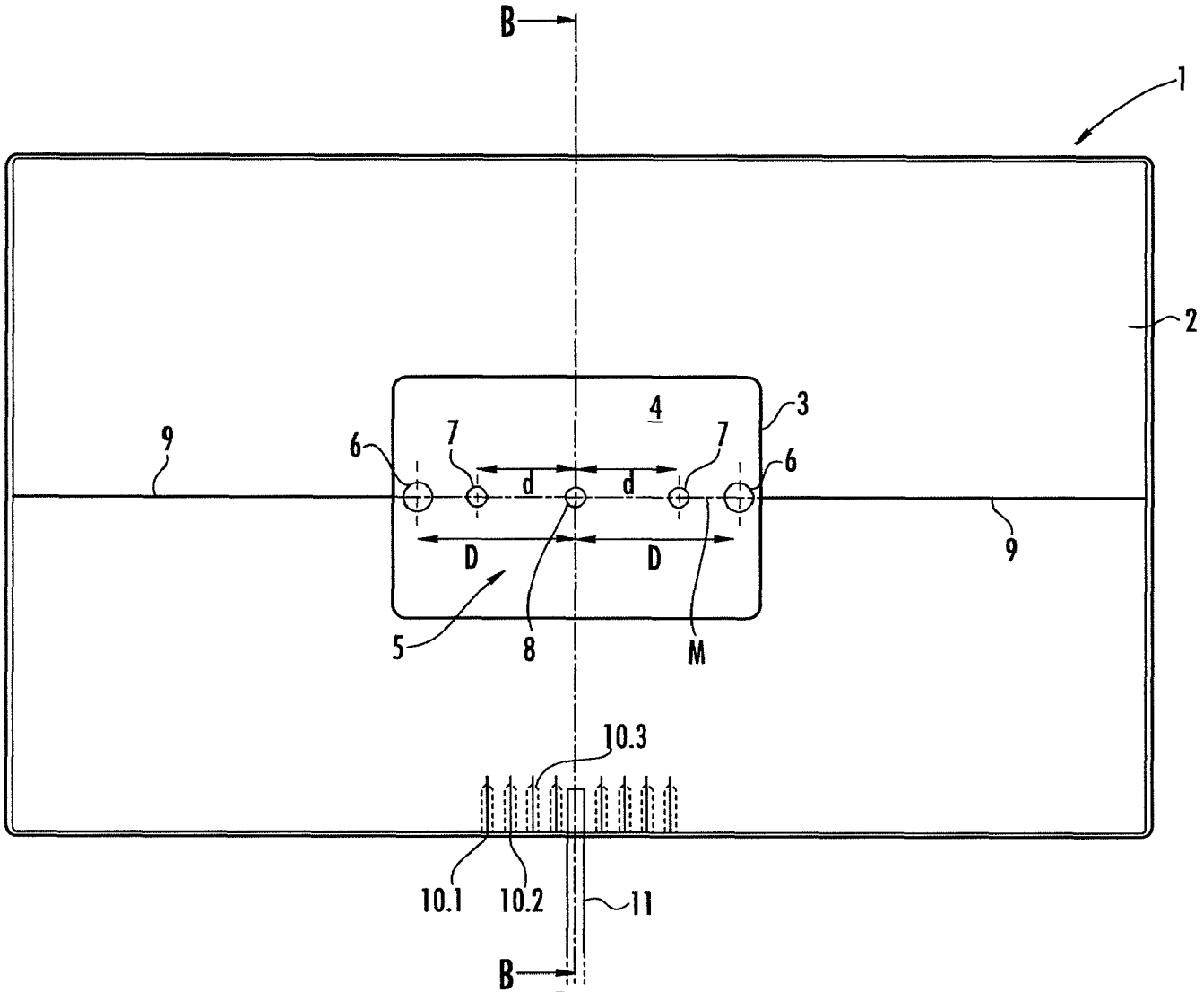
FIG. 1 shows a top view of an embodiment of the putter fitting device according to the invention.

FIG. 1 shows an embodiment of the putter fitting device according to the invention, which in its entirety is marked with the reference character 1. The putter fitting device 1 comprises a ground or base plate 2, which preferably is designed from a relatively dense, preferably solid metallic material, without the present invention being limited to such an embodiment, though. The base plate 2 comprises a central recess or indentation 3, with its bottom 4 being embodied of a color and/or material different in reference to the remaining base plate 2, for example by applying an enamel coating or inserting a felt cover or the like.

In the area of the recess 3, the base plate 2 comprises a fixation device 5 for a putter head (not shown in FIG. 1), with its embodiment being discussed in greater detail in the following.

The fixation device 5 is embodied redundantly symmetrical in reference to a symmetry axis of the putter fitting device 1 (cf. line B-B in FIG. 1) and first comprises a recess 6 at both sides of said line and at an identical distance D therefrom, which is preferably embodied as bored sockets that are glued in. The recesses 6 serve to accept a fixing element (not shown) for the putter head, which is to be explained in greater detail in the following. Additional recesses 7 are also arranged inversely and at both sides of the line B-B at a distance d, with their purpose also being explained in greater detail in the following. Here, all of the above-mentioned recesses 6, 7 are located on a line coinciding with the central line M of the putter fitting device 1.

In the center of the arrangement, i.e. at the intersection of the central line M with the line B-B, the fixation device 5 comprises another fixation structure in the form of a projection, here embodied as a pin or a peg 8 extending perpendicular in reference to the plane of the base plate 2 (plate plane). The projecting structure 8 cooperates with a complementary structure (recess) at the putter head, not shown here, which is explained in greater detail in the following.

Outside the recess 3, in the extension of the central line M and inversely at both sides of the line B-B, the putter fitting device 1 comprises one alignment marker each in the form of an alignment line 9, with its precise embodiment also being explained in greater detail in the following.

At the edge of the base plate 2, parallel in reference to the alignment line 9, the putter fitting device comprises a number of recesses (bores 10.1, 10.2, . . . ), each of which serves to receive a rod-like oblong element 11, with the latter serving to function as an adjustable positioning element to predetermine the stance of a person (not shown) in reference to the base plate 2. Such a positioning element is generally known from the German application 10 2008 027 152.7 of the same applicant, which is here explicitly referred to. In order to assume a reproducible stance in reference to a base plate 2 and/or the entire putter fitting device 1, the person stands with his/her feet symmetrically at both sides of the oblong element 11 at a certain distance from the base plate 2. For a targeted change of said stance the oblong element 11 can be inserted into another recess 10.1, 10.2, . . . of the base plate 2, which is not discussed in further detail, here.

Figure 2:
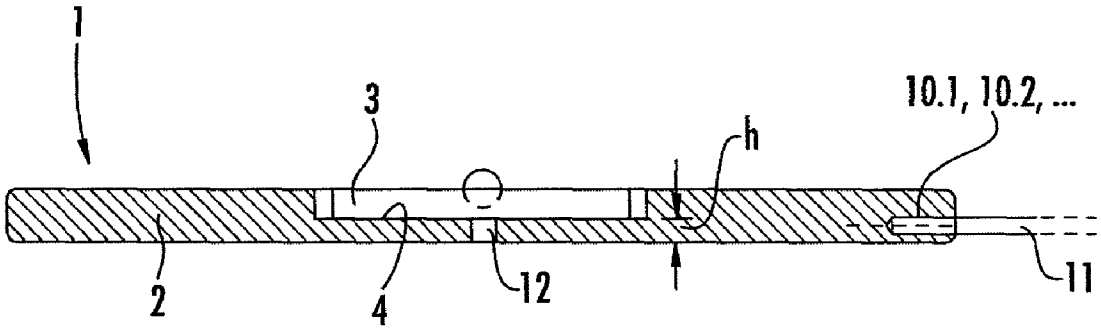
FIG. 2 shows a cross-section through the putter fitting device along the line B-B in FIG. 1.

FIG. 2 shows a cross-section through the putter fitting device 1 along the line B-B in FIG. 1. Identical or equivalent elements are here, as in the subsequent figures, generally marked with the same reference characters as in FIG. 1.

Here, it must be observed that in FIG. 2, deviating from the above description of FIG. 1, no pin 8 (cf. FIG. 1) is (yet) present in the center of the device 1. Instead thereof, in FIG. 2 only a bore 12 is shown at the respective location, which accordingly serves as the receiver for the pin 8 according to FIG. 1.

In FIG. 2, the thickness of the base plate 2 in the area of the recess 3 is marked with the reference character h. It preferably amounts to 6.0 mm, which is precisely equivalent to the preferred distance of the bottom of the putter head from the green of a golf course when executing a putt.

Figure 3:
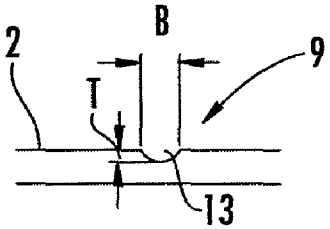
FIG. 3 shows a detailed view according to the letter C in FIG. 2.

FIG. 3 shows a detailed illustration of the base plate 2 in the area C according to FIG. 2. A particular embodiment of the alignment line 9 is shown, described above using FIG. 1, which is embodied in the form of a recess 13, partially circular in its cross-section, having a width B and a depth T. Furthermore, in the area of the recess 13 a coloration can be applied contrasting in reference to the material of the base plate 2.

Figure 4:
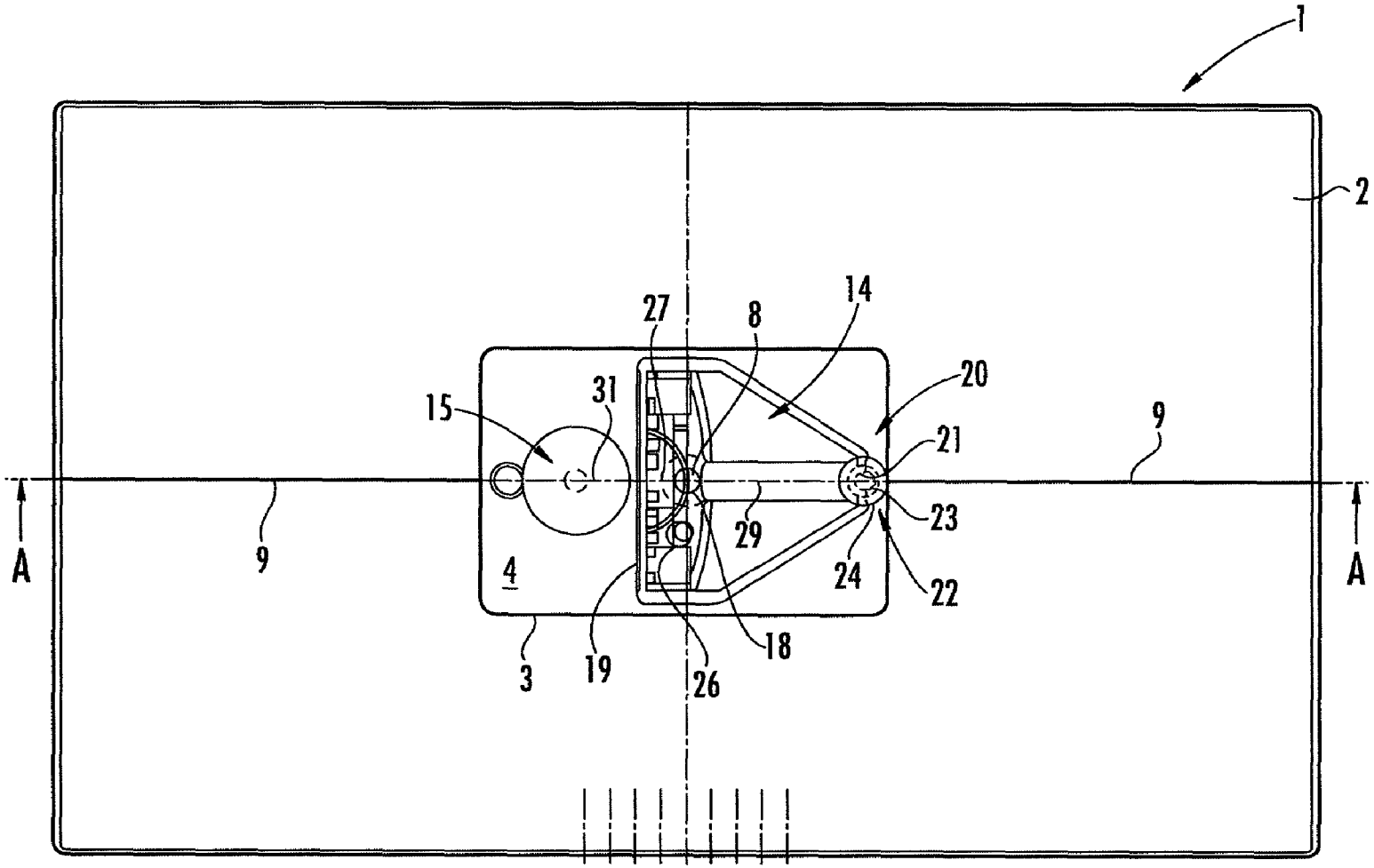
FIG. 4 shows a top view of the putter fitting device according to FIG. 1 with a putter and/or putter head and a golf ball placed thereupon, with the putter head being fixed in a torque-proof fashion.

FIG. 4 shows a top view of the putter fitting device 1 essentially equivalent to FIG. 1, however, the insertion recesses 10.1, 10.2, . . . and the oblong positioning element 11 are not shown here, either. However, the illustration according to FIG. 4 additionally shows a putter head 14 as well as a golf ball 15, with their arrangement in reference to the remaining putter fitting device 1 being discussed in greater detail in the following. The putter head 14 is embodied in a mallet form, here, however the invention is not limited to such a design of the putter head.

Figure 5:
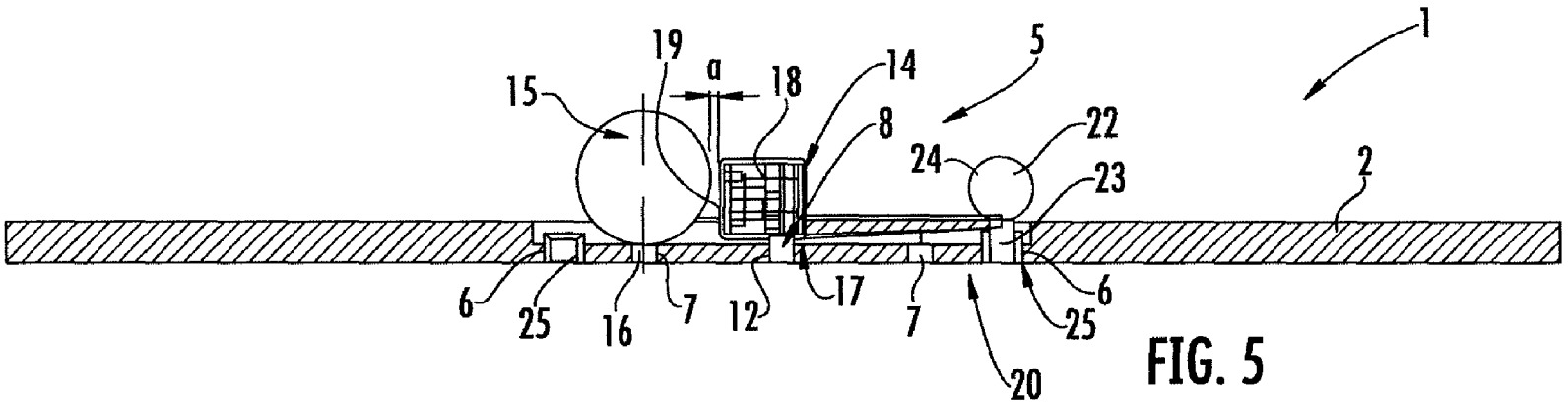
FIG. 5 shows a cross-section along the line A-A in FIG. 4.

In order to describe the arrangement according to FIG. 4, reference is also made to the cross-sectional view in FIG. 5, which shows a longitudinal cross-section along the line A-A in FIG. 4. Accordingly, the golf ball 15 has a pin-shaped protrusion at the reference character 16, by which it can be inserted into an already-described recess 7 of the base plate 2 (cf. FIG. 1.) At the reference character 8 the device now again shows the already mentioned pin, which is pressed into the recess 12 of the base plate 2 already shown in FIG. 2. The pin 8 engages a socket 17 of the putter head 14, which optionally is inserted into a recess or bore 18 in the putter head 14, which is particularly well discernible in FIG. 4. The above-mentioned bore 18 extends perpendicularly in reference to the putter head 14, i.e. essentially parallel in reference to its impact area 19, except for the so-called loft amounting here to 3.25°, for example. The impact area shows a distance a from the golf ball 15 in the exemplary embodiment shown in FIG. 4 and FIG. 5.

The cooperation of the putter head bore 18 and the pin 8 achieves a torque-proof fixation of the putter head 14 in reference to the device 1 and/or the floor plate 2 when the putter head 14 is placed with its bore 18 upon the pin 8.

In order to achieve a torque-proof fixation of the putter head 14 in reference to the base plate 2 the putter head 14 comprises a recess or notch 21 at its back 20 facing away from the impact area 19, which cooperates with a fixation element 22 of the putter fitting device 1. In the present invention the latter is embodied in the form of a pin 23, which is connected to a spherical head 24 or alternatively to a toothed head (not shown), particularly via a screwed connection. The pin 23 is inserted into a recess 6 of the base plate 2, into which a bored socket 25 had been glued. The fixation element 22 engages the rear recess 21 of the putter head 14 with its pin 23, and this way prevents its rotation around the pin 8 so that a torque-proof fixation of the putter head 14 is achieved in reference to the base plate 2 of the device 1.

As easily discernible by one skilled in the art, the entire arrangement comprising a base plate 2, a golf ball 15, and a putter and/or a putter head 14 may also be embodied inversely in reference to the line B-B in FIG. 1, in order to allow the use of the described putter fitting device both by right-handed as well as left-handed persons.

In the following, a few particular features of the putter head 14 are explained in greater detail:

Referring particularly to FIG. 4, the putter head 14 comprises a recess at the reference character 26 to insert the shaft of a putter (not shown in FIG. 4), into which the shaft of a putter can be inserted such that the lie-angle (or lie for short), i.e. the angle between the putter shaft and the ground and/or green is adjustable when the putter head is placed in a planar fashion, for example by tightening a clamping screw (not shown.)

Furthermore, the reference character 27 marks a marker line on the putter head 14, which extends perpendicularly and centrally in reference to the impact area 19. In addition to the marker line 27 the putter head 14 comprises another central marker line 29, which is embodied lower in reference to the marker line 27 and is aligned thereto.

An alignment of the marker lines 27 and 29 that can be recognized by the player requires that the player is in the so-called base position for putting. When additionally an equatorial marker line 31, perhaps applied on the golf ball 15, is aligned to the marker lines 27, 29, the center of his/her eyes is also located directly above the center of the ball, which completes the above-mentioned base position.

Such embodiments of putter heads 14 are known, as already mentioned. However, as shown here, the arrangement comprising a putter head 14 and a golf ball 15 with the putter head 14 being fixed in a torque-proof fashion, i.e. with the inserted pin 8 and the fixation element 22, is characterized such that the impact area 19 of the putter is "square" in reference to the ball 15, which means that the marker lines 9, 27, 29 and perhaps 31 are aligned.

Figure 6:
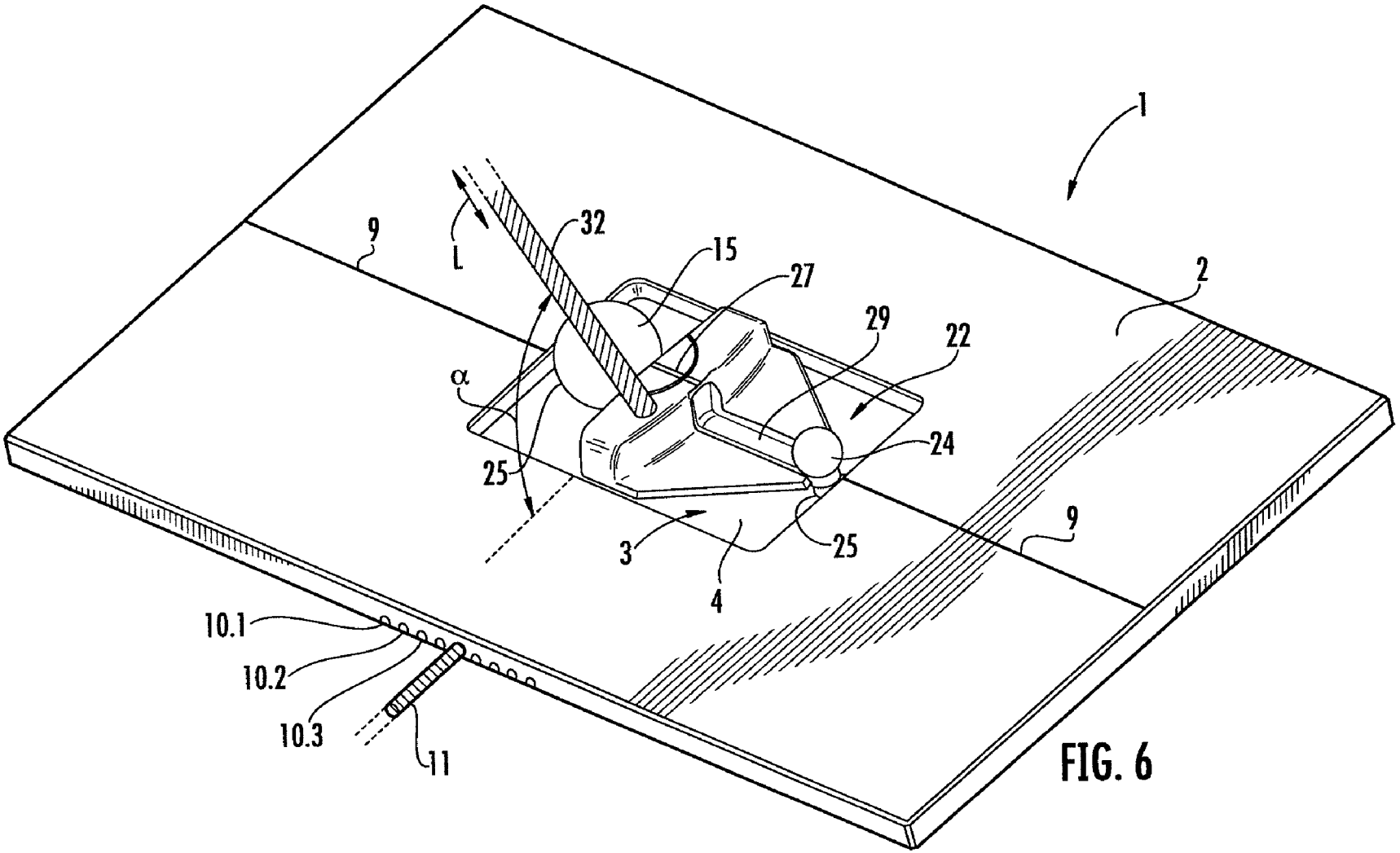
FIG. 6 shows a perspective overall view of the putter fitting device with a fixed putter head and a golf ball according to FIGS. 4 and 5.

FIG. 6 once more illustrates the above-described connections using a perspective overall representation, here including an indicated shaft 32 of the putter, which is adjustable in reference to the lie angle α and the length L of the shaft, symbolized in FIG. 6 by respective double arrows.

In the following, the use according to the invention of the above-described fitting station is described comprising the putter fitting device 1 and the corresponding putter with the putter head 14 and the shaft 32:

The putter is placed with its head 14 in the recess 3 of the putter fitting device 1, this means its bottom recess 18 is plugged onto the pin 8 and in this position fixed via the fixation element 22 (cf. FIG. 4) in a torque-proof fashion. In this first torque-proof fixation subsequently the lie angle α and the length L of the shaft can easily be adjusted to a person, who for said purpose takes a symmetrical stance in reference to the positioning element 11, as above-described in greater detail. Here, the person continues to assume the basic putting position, in which the marker lines 31, 27, and 29 are aligned to the golf ball 15 and/or the putter head 14, which has also been described above in greater detail.

When this way potential adjustments have been made at the putter the fixation element 22 is removed so that the putter head 14 now is fixed in reference to the base plate 2, rotational around the pin 8. Beneficially the person using the device 1 closes his/her eyes, here, and tries intuitively and/or based on his/her natural posture to find the optimal impact position in reference to the golf ball 15. Subsequently, a comparison of the orientation of the marker lines 27 and 29 at the putter head 14 with the marker lines 9 on the base plate 2 and/or with the marker lines 31 on the golf ball shows if the discovered playing or putting position is "square", i.e. if the above-mentioned marker lines are still aligned as in the case of the first, torque-proof fixation of the putter head 14. If that is the case, the discovered stance or base position, predetermined by the positioning element 11 in a reproducible fashion, is optimal for the respective person and the fitting is completed. In other words: the person now knows the length of the shaft necessary for his/her play, the corresponding lie, and the stance to be assumed.

Alternatively, which means when the above-mentioned marker lines are no longer aligned after the intuitive putting position has been assumed, the stance must be corrected in reference to the base plate 2. For this purpose, the positioning element 11 is inserted laterally offset into the base plate 2 and the stance is adjusted accordingly. When for example after the intuitive putting position has been assumed the marker line 29 of the putter head 14 in FIG. 4 is rotated upwards in reference to the right alignment line 9 the positioning element will then accordingly be moved to the left and the fitting is subsequently controlled using the new stance to be assumed. In the event the marker line 29 is rotated downwards in reference to the right alignment line 9 the positioning element 11 in the base plate 2 is accordingly moved to the right.

Deviating from the above-described exemplary embodiment the shaft 32 of the putter may at least partially comprise an exterior square shape or the like, in order to achieve torque-proofing at least the grip section (not shown) of the putter.

Furthermore, deviating from the above-described embodiment the rotational fixation of the putter head 14 may also occur such that it comprises a pin-like protrusion at its bottom, which can be inserted into a suitable complementary recess of the base plate 2 (for example equivalent to the bore 12 according to FIG. 2 or FIG. 5.)

The base plate 2 of the device 1 is preferably made from a relatively heavy, massive material in order to ensure a safe stand. Here, the base plate 2 may furthermore comprise suitable devices, particularly for mounting advertisement panels and/or a panel with appropriate how-to use notes. Furthermore, within the scope of another embodiment of the above-described fitting station it may also be provided that the fixation element 22 is arranged for a torque-proof fixation of the putter head 14 in a first fixation at the putter head 14 itself.

Instead of a lower positioned marker line 29 (cf. FIG. 4), two parallel marker lines may also be provided at the putter head 14, so that the higher positioned marker line 27 and/or its virtual extension is positioned straight between these two lines like in a line-of-sight alignment when the player assumes the basic putting position.

The invention claimed is:

1. A putter fitting device (1) comprising a base plate (2) with a fixation device (5) for a putter head (14), which provides a first fixation state for a first, torque-proof fixation of the putter head (14) or a second fixation state for a second, rotational fixation of the putter head (14) in reference to the base plate (2), with the putter head (14) in the second fixation state being rotational in a plate plane of the base plate (2), an adjustable positioning body (11) is connected to the base plate to predetermine a stance of a person in reference to the base plate (2), and alignment markings (9, 27, 29) for a targeted alignment of the putter head (14) in the second fixation state and for controlling a selected alignment of the putter head (14).

2. A putter fitting device (1) according to claim 1, wherein the fixation device (5) comprises a first fixation structure (8) for a rotational connection to the putter head (14) in the second fixation state, cooperating with a complementary first fixation structure (17, 18) at the putter head (14).

3. A putter fitting device (1) according to claim 2, wherein the first fixation structure (8) comprises a protrusion extending perpendicularly in reference to the plate plane of the base plate (2).

4. A putter fitting device (1) according to claim 2, wherein the fixation device (5) comprises a second fixation structure (6, 22, 25) for a selective blocking of a rotary motion of the putter head (14) for the first fixation state, cooperating with a complementary second fixation structure (21) at the putter head (14).

5. A putter fitting device (1) according to claim 4, wherein the second fixation structure comprises a recess (6, 25) in the base plate (2) and a fixation element (22) that can be inserted into the recess.

6. A putter fitting device (1) according to claim 2, wherein the alignment markings comprise at least one alignment line (9) applied on the base plate (2) and at least the first fixation structure (8) is arranged on or in an extension of the alignment line (9).

7. A putter fitting device (1) according to claim 1, wherein the base plate (2) comprises a recess (3) for accepting the putter head (14), and a bottom (4) of the recess (3) comprised at least one of a different color or material than a remaining portion of the base plate (2).

8. A putter fitting device (1) according to claim 7, wherein the fixation device (5) is arranged in an area of the recess (3).

9. A putter fitting device (1) according to claim 1, wherein in an area of the fixation device (5) at least one positioning device (7) for a golf ball (15) is arranged such that it assumes a position at a distance (a) from an impact area (19) of the putter head (14).

10. A putter fitting device (1) according to claim 4, wherein the fixation device (5) is embodied inversely redundant in reference to the base plate (2), with at least the second fixation structure (6, 25) being provided in duplicate.

11. A putter fitting device (1) according to claim 1, wherein the positioning body comprises a straight, oblong element (11), which projects laterally from the base plate (2) and which can be positioned in various settings in reference thereto.

12. A putter fitting device (1) according to claim 11, wherein the oblong element (110 can be inserted into the base plate (2) in certain positions (10.1, 10.2, . . . ) laterally projecting therefrom, and be held here in a form-fitting and detachable manner.

13. A putter fitting device (1) according to claim 12, wherein the base plate (2) comprises a number of insert openings (10.1, 10.2, . . . ) for inserting the oblong element (11), which are arranged in an edge area of the base plate (2).

14. A putter fitting device (1) according to claim 13, wherein at least one of settings or the insert openings (10.1, 10.2, . . . ) are arranged along a first straight line extending parallel in reference to a second straight line (9), which is a part of the alignment markings.

15. A putter fitting device (1) according to claim 1, further comprising the putter with a fixation device (18, 21) that cooperates with the fixation device (5) of the putter fitting device (1).

16. A putter fitting device (1) according to claim 3, further comprising the putter which includes a first fixation structure (19) that cooperates with the first fixation structure (8) of the putter fitting device (1).

17. A putter fitting device according to claim 4, further comprising the putter which includes a second fixation structure (21), cooperating with the second fixation structure (6, 22, 25) of the putter fitting device (1).

18. A putter fixing device according to claim 6, further comprising the putter including at least one alignment line (27, 29) that is aligned to the alignment line (9), at least in a first fixation of the putter at the putter fitting device (1).

19. A putter fixing device according to claim 15, wherein the putter is adjustable with regard to at least one of a length (L) of the shaft or a lie angle ($\alpha$).

20. A putter fixing device according to claim 15, wherein a device (27, 29) for determining the posture of a person in reference to a putter head (14), particularly an arrangement in the line-of-sight.

* * * * *